US009856877B2

(12) United States Patent
Warner et al.

(10) Patent No.: US 9,856,877 B2
(45) Date of Patent: Jan. 2, 2018

(54) VACUUM PUMP HAVING A DISCONNECTABLE DRIVE COUPLING

(71) Applicant: WABCO Automotive UK Limited, Batley Yorkshire (GB)

(72) Inventors: Simon Warner, Batley Yorkshire (GB); David Heaps, Batley Yorkshire (GB)

(73) Assignee: WABCO AUTOMOTIVE UK LIMITED, Batley, Yorkshire (GB)

( * ) Notice: Subject to any disclaimer, the term of this patent is extended or adjusted under 35 U.S.C. 154(b) by 280 days.

(21) Appl. No.: 14/650,595

(22) PCT Filed: Dec. 19, 2013

(86) PCT No.: PCT/EP2013/077392

§ 371 (c)(1),
(2) Date: Jun. 9, 2015

(87) PCT Pub. No.: WO2014/096195

PCT Pub. Date: Jun. 26, 2014

(65) Prior Publication Data

US 2015/0316059 A1 Nov. 5, 2015

(30) Foreign Application Priority Data

Dec. 20, 2012 (EP) ..... 12198576

(51) Int. Cl.

| | |
|---|---|
| ***F04C 29/00*** | (2006.01) |
| ***F04C 18/356*** | (2006.01) |
| ***F04C 18/344*** | (2006.01) |
| ***F04C 28/06*** | (2006.01) |
| ***F04C 25/02*** | (2006.01) |
| *F04C 28/28* | (2006.01) |

(52) U.S. Cl.
CPC ..... *F04C 29/005* (2013.01); *F04C 18/344* (2013.01); *F04C 18/356* (2013.01); *F04C 25/02* (2013.01); *F04C 28/06* (2013.01); *F04C 29/0071* (2013.01); *F04C 28/28* (2013.01)

(58) Field of Classification Search
CPC ..... F04C 29/005; F04C 29/0071
See application file for complete search history.

(56) References Cited

U.S. PATENT DOCUMENTS 1,718,197 A * 6/1929 Starkey ..... F16D 41/206 192/47

FOREIGN PATENT DOCUMENTS

| | | | | |
|---|---|---|---|---|
| EP | 2 049 355 A1 | | 4/2009 | |
| GB | 1338446 A | * | 11/1973 | ..... B60W 30/1819 |
| WO | WO 00/31419 A1 | | 6/2000 | |
| WO | WO 2008/061749 A1 | | 5/2008 | |
| WO | WO 2008061749 A1 | * | 5/2008 | ..... F04C 14/06 |
| WO | WO 2012/164466 A1 | | 12/2012 | |

* cited by examiner

*Primary Examiner* — Mary A Davis
(74) *Attorney, Agent, or Firm* — Leydig, Voit & Mayer, Ltd.

(57) ABSTRACT

To provide a failsafe drive coupling capable of high torque transmission in direct dog drive, a vacuum pump drive is disconnectable from a drive shaft upon movement of a piston against a return spring, under the action of oil pressure. The piston comprises a speed synchronizing clutch engageable with the input shaft to rotate the piston at the speed of the input shaft, and teeth to directly dog the piston and input shaft together.

15 Claims, 5 Drawing Sheets

VACUUM PUMP HAVING A DISCONNECTABLE DRIVE COUPLING

FIELD OF THE INVENTION

The present invention generally relates to vacuum pumps.

BACKGROUND OF THE INVENTION

Conventionally, small and medium sized vehicles are provided with hydraulic brake systems having vacuum assistance via vacuum boosters. Historically the source of vacuum was from the inlet manifold of a gasoline engine, or from a vacuum pump of a diesel engine. More recently, vacuum pumps have been provided for both gasoline and diesel vehicles.

Dry running vacuum pumps driven by an electric motor have been proposed, but, for reliability and long life, an oil-lubricated mechanically driven vacuum pump is often preferred. Such a pump is typically driven directly from an engine camshaft, though other mechanical arrangements are possible.

Engine driven vacuum pumps rotate continuously, and exert a small drag on the vehicle engine, due to friction and pumping losses. It is desirable to minimize such parasitic loss, so as to improve overall fuel consumption of the vehicle, especially since vacuum pumps may not be required for long time periods—for example when driving on highways where brake application is infrequent.

It has been proposed (e.g., in EP2049355A) to provide a disengageable friction clutch whereby drive to the pump rotor can be engaged and disengaged on demand. However, a friction drive may be problematic under cold start conditions (−30° C.), because a high drive torque may be required to clear lubrication oil accumulated in the vacuum pump. Such a high torque may result in reduced clutch life, which is not compatible with failsafe operation. Furthermore, a friction clutch may be physically large.

Equally, a mechanical drive connection, such as a dog clutch is not considered practicable because of the shock loading when the drive to the vacuum pump is connected.

What is required is a failsafe disconnectable drive for a vacuum pump, which is capable of cold start engagement without shock loading, and which preferably does not require electrical components or electrical connections.

SUMMARY OF THE INVENTION

According to an embodiment of the present invention, a vacuum pump is provided having a disconnectable drive coupling. The disconnectable drive coupling includes an input shaft, a co-axial output shaft and a coupling sleeve movable axially of the shafts. The disconnectable drive coupling further includes a speed synchronizing clutch and drive formations. The coupling sleeve is resiliently urged to an engaged condition where the input shaft is coupled for rotation with the output shaft, the coupling sleeve forming part of an annular piston that is movable in response to an increase in fluid pressure to achieve a disengaged condition where the input shaft is decoupled from rotation with the output shaft.

The speed synchronizing clutch can synchronize the speed of the input and output shafts prior to coupling the shafts together such that relative rotation is obviated. In the engaged condition, the input shaft is directly coupled to the output shaft via the drive formations, which are provided on both shafts. Fluid under pressure, preferably liquid, is utilized to move the annular piston from the engaged to the disengaged position. Preferably, the liquid is lubrication oil supplied from the engine of the vehicle to which the vacuum pump is fitted.

In one embodiment, the input shaft is journalled in the output shaft, the output shaft defines a cylinder bore for the piston, and the piston is fixed against rotation relative to the cylinder bore. In such an arrangement, the shafts can be disconnected, but, on demand, will engage to progressively reduce a speed differential until the drive dogs can be safely engaged. The speed synchronizing clutch comprises mutually engageable clutch faces, associated with driving and driven sides, one of which is displaceable against a resilient force.

The piston may comprise a base, and wall defining a sleeve, the dog drive being provided by drive teeth at the base engageable with drive teeth of the input shaft.

In one embodiment, the sleeve is circular and comprises an internal clutch ring fixed in rotation therewith, and movable axially thereof, the clutch ring defining a circular clutch face engageable with a corresponding circular clutch face of the input shaft. The clutch face and clutch ring together comprise the mechanism for synchronizing the rotational speed of the input shaft and piston.

The clutch faces may be defined by a single dry plate clutch, a wet multi-plate clutch, or a cone clutch. Other kinds of clutch are also possible.

One of the clutch faces may be biased into engagement by resilient means acting between the input shaft aid the clutch ring, and the piston may engage a shoulder of the input shaft in the engaged condition. In one embodiment, the clutch ring is metal, and, thus, substantially non-wearing.

It will be appreciated that the inventive drive is resiliently urged into engagement, and is, thus, failsafe.

In one embodiment, the drive includes a housing defining a bore defining a bearing to receive the output shaft for rotation therein.

The output shaft preferably comprises a rotor of the vacuum pump, and the housing comprises a rotor chamber of the vacuum pump.

In one embodiment, the housing includes an inlet for fluid under pressure, the inlet opening to the bearing, and being connected via the bearing to the piston to facilitate movement to the disengaged condition; the inlet may be connected via the bearing to the pump rotor to facilitate lubrication thereof. When connected to a vehicle engine, lubrication oil for the engine can be used for lubrication and actuation of the drive coupling.

In a further embodiment, the inventive disconnectable drive of a vacuum pump comprises a housing defining a rotational axis and a housing defining a first cylindrical chamber about the axis. An annular piston is rotationally fast with the first chamber and slidable in the first chamber along the axis. A spring urges the piston in one axial direction. The piston comprises a base and a skirt, and the skirt defines a second cylindrical chamber about the axis, and has within a clutch ring rotationally fast with the piston and slidable in the second chamber along the axis. An input shaft is rotatable on the rotational axis within the piston. The input shaft and clutch ring define mutually engageable clutch faces, one clutch face facing the base of the piston, and the base of the piston and the input shaft have mutually engageable teeth for direct drive, whereby axial movement of the piston relative to the shaft in the one direction progressively engages the clutch faces, further relative axial movement engaging the teeth.

In one embodiment, the input shaft and clutch ring define mutually tapered male and female clutch faces, the male clutch face facing the base of the piston.

According to a further aspect of the present invention there is provided a disconnectable drive coupling. The disconnectable drive coupling includes an input shaft, a co-axial output shaft and a coupling sleeve movable axially of the shafts. The disconnectable drive coupling further has a speed synchronising clutch and drive formations, wherein the coupling sleeve is resiliently urged to an engaged condition where the input shaft is coupled for rotation with the output shaft, the coupling sleeve forming part of an annular piston that is movable in response to an increase in fluid pressure to achieve a disengaged condition where the input shaft is decoupled from rotation with the output shaft.

The speed synchronising clutch can synchronize the speed of the input and output shafts prior to coupling the shafts together such that relative rotation is obviated. In the engaged condition, the input shaft is directly coupled to the output shaft via the drive formations, which are provided on both shafts. Fluid under pressure, preferably a liquid, is used to move the annular piston from the engaged to the disengaged position.

In an embodiment, the input shaft is journalled in the output shaft, the output shaft defines a cylinder bore for the piston, and the piston is fixed against rotation relative to the cylinder bore.

in such an arrangement, the shafts can be disconnected, but, on demand, will engage to progressively reduce a speed differential until the drive dogs can be safely engaged. The speed synchronising clutch comprises mutually engageable clutch faces, associated with driving and driven sides, one of which is displaceable against a resilient force.

The piston may comprise a base, and wall defining a sleeve, the dog drive being provided by drive teeth at the base engageable with drive teeth of the input shaft.

In an embodiment, the sleeve is circular and comprises an internal clutch ring fixed in rotation therewith, and movable axially thereof, the clutch ring defining a circular clutch face engageable with a corresponding circular clutch face of the input shaft. The clutch face and clutch ring together comprise the mechanism for synchronizing the rotational speed of the input shaft and piston. The clutch faces may be defined by a single dry plate clutch, a wet multi plate clutch, or a cone clutch. Other kinds of clutch are also possible.

One of the clutch faces may be biased into engagement by resilient means acting between the input shaft and the clutch ring, and the piston may engage a shoulder of the input shaft in the engaged condition. In one embodiment, the clutch ring is metal, and, thus, substantially non-wearing.

The inventive drive is resiliently urged into engagement, and is, thus, failsafe.

In an embodiment, the drive includes a housing defining a bore defining a bearing to receive the output shaft for rotation therein.

The output shaft preferably comprises a rotor of a vacuum pump, and the housing comprises a rotor chamber of a vacuum pump.

In an embodiment, the housing includes an inlet for fluid under pressure, the inlet opening to the bearing, and being connected via the bearing to the piston to facilitate movement to the disengaged condition; the inlet may be connected via the bearing to the pump rotor to facilitate lubrication thereof. Typically, when connected to a vehicle engine, lubrication oil for the engine is used for lubrication and actuation of the inventive drive coupling.

Still other objects and advantages of the present invention will in part be obvious and will in part be apparent from the specification.

The present invention accordingly comprises the features of construction, combination of elements, and arrangement of parts, all as exemplified in the constructions herein set forth, and the scope of the invention will be indicated in the claims.

BRIEF DESCRIPTION OF THE DRAWINGS

The present invention is discussed in greater detail below on the basis of exemplary embodiments illustrated in the accompanying drawings, in which.

LIST OF REFERENCE SYMBOLS

Figure 1:
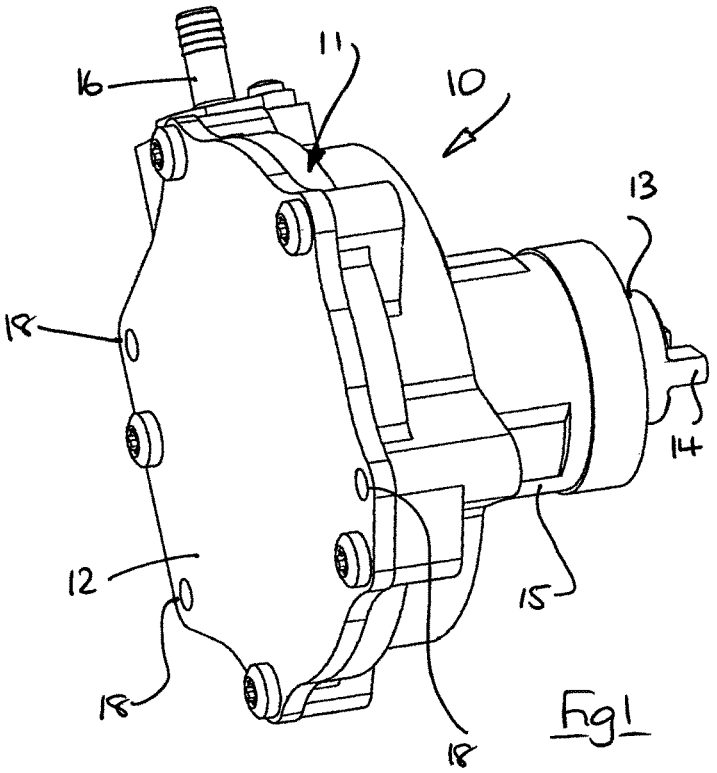
FIG. 1 is a perspective view of one end of a vacuum pump according to an embodiment of the present invention.

10 vacuum pump
11 rotor chamber
12 end plate
13 input shaft
14 drive dogs (Oldham coupling)
15 smaller diameter end
16 inlet connection
17 non-return valve
18 mounting holes
19 bearing surface
20 disconnectable drive coupling
21 pump housing
22 output shaft/pump rotor
23 cylinder bore
24 annular piston
25 splines
26 disc springs
27 piston ring
28 piston base
**28*a*** piston wad
29 bearing
**29*a*** bearing surface
30 oil seal
31 clutch face of input shaft
32 clutch ring
33 splines
34 disc springs (Belleville washers)
35 circlip
36 driving teeth
37 driven teeth
38 shoulder
41 inlet
42 groove
43 drain passage
44 shuttle valve/exhaust valve
45 shuttle valve bore
46 axial groove

47 radial and axial drain passages
48 central drain bore
49 thrust washer
50 undercut
59 lubrication path
60 pressure oil source
61 control signal line
62 piston chamber
63 drain
64 vehicle engine
65 vacuum reservoir
66 vacuum duct
67 non-return valve
68 reference signal line
69 vacuum valve
70 atmosphere
71 brake master cylinder
72 vacuum booster
73 fluid reservoir
74 brake pedal
75 brake pressure
76 vehicle structure
77 driving shaft
80 pump rotor
81 rotor shaft bore

DETAILED DESCRIPTION OF THE PREFERRED EMBODIMENTS

With reference to FIG. 1, a vacuum pump 10 according to an embodiment of the present invention comprises a housing having an enlarged end comprising a rotor chamber 11 and containing a rotatable pump rotor 80 and sliding vane of conventional kind. The kind of pump mechanism is not relevant here, provided that it is of the rotating kind. An end plate 12 closes the rotor chamber.

The pump rotor 80 is driven by an input shaft 13, which revolves within a smaller diameter end 15 of the pump body and has drive dogs 14 (for example, an Oldham coupling) for engagement with one end of a camshaft of an internal combustion piston engine. Other kinds of drive connection to the camshaft may be used. Practically speaking, the entire smaller diameter end of the housing is inserted in a casing of the engine, so that only a larger diameter end is visible in use. Within the vacuum pump is a disconnectable drive coupling 20 (FIG. 3), which is discussed in greater detail hereinafter.

The pump rotor 80 comprises a radially external bearing surface 19 that runs in a bore 81 defined by the housing of the pump.

The pump chamber includes an inlet connection 16 adapted to be coupled to the vacuum hose of a brake booster, and a non-return outlet valve 17.

The pump rotates with the camshaft, and pumps air from the inlet to the outlet so as to reduce air pressure on the inlet side, and thereby create a partial vacuum in the brake booster vacuum chamber.

Figure 2:
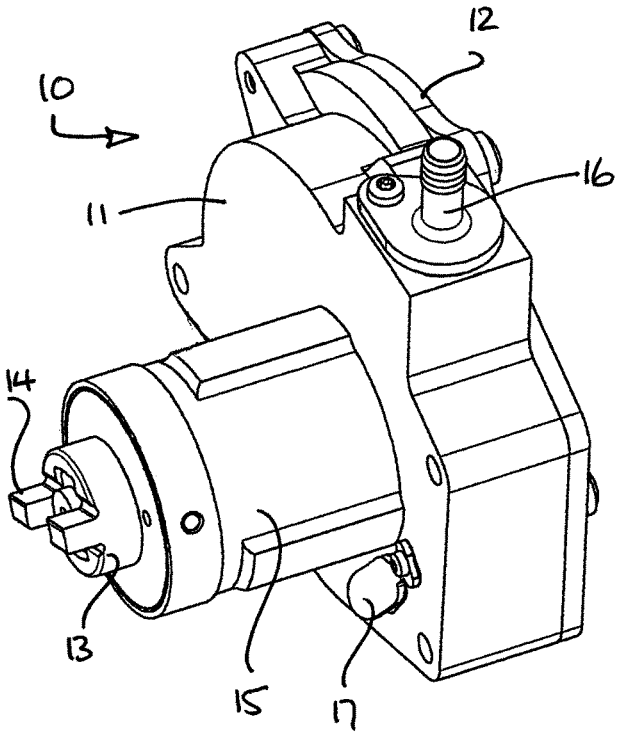
FIG. 2 corresponds to FIG. 1 and shows the vacuum pump from other end.
Figure 3:
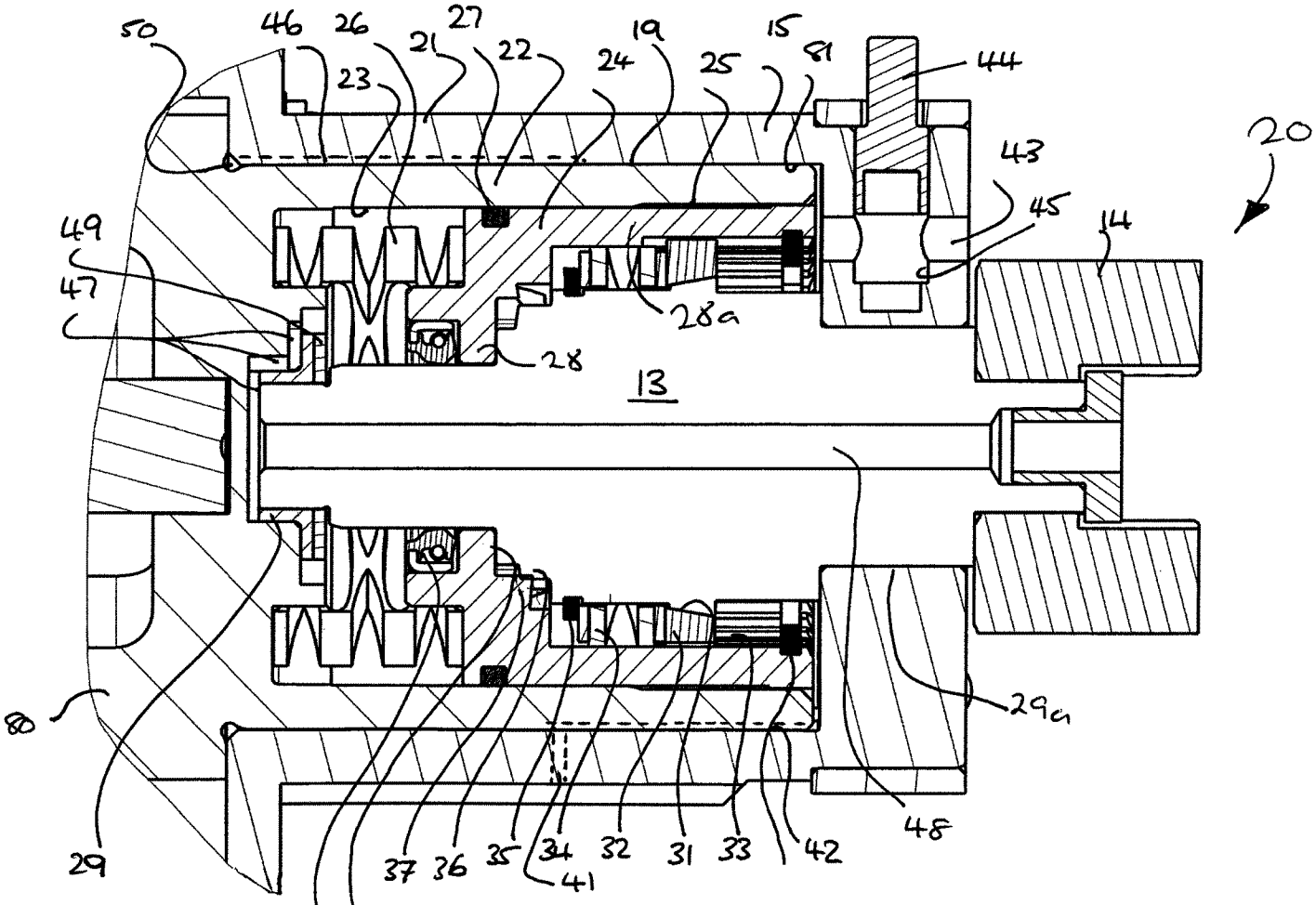
FIG. 3 is an axial cross-section through the pump of FIGS. 1 and 2, omitting the pump chamber.

FIG. 3 shows a transverse cross section though the smaller diameter end 15 of the pump of FIGS. 1 and 2; the pump chamber at the left end is omitted.

The pump housing 21 comprises a casting of iron, aluminium or other suitable material, and defines a bearing within which an output or support shaft 22 of a pump rotor is rotatable. The shaft 22 and pump rotor may be formed on a single unitary component.

The shaft 22 has a blind circular chamber comprising a cylinder bore 23 within which an annular piston 24 is reciprocal along the rotational axis. The piston 24 and bore 23 are rotationally connected by splines 25. The piston 24 is resiliently biased to the right end of the bore 23 (as viewed) by a stack of disc springs 26 arranged back to back, which bear on the blind end of the bore 23. The piston includes a piston ring 27 to seal against the wall of the bore 23.

Rotatable within the piston 24 is the input shaft 13, which is supported at either end of the bore 23 by, respectively, a plain bearing 29 und a bearing surface 29*a*. An oil seal 30 is provided between the piston 24 and the shaft 13.

Between the input shaft 13 and the piston 24 is arranged a clutch, which comprises a speed synchronizing mechanism. A first circular clutch face 31 is defined on the input shaft and is in the form of a flat taper facing the pump chamber. A second mating clutch face is defined by a circular clutch ring 32 within the piston 24. The ring 32 is rotationally fast with the piston 24 by virtue of splines 33, but is able to move axially, as described below.

The ring 32 is resiliently biased to the right, as viewed, by disc springs 34 which react against a circlip 35 engaged in a groove of the input shaft 13.

Disc springs 26, 34 are convenient, but other kinds of resilient spring bias may be used if desired.

The clutch in this embodiment is a cone clutch, but plate clutches of any kind are also suitable. A wet multi-plate clutch is an alternative.

The piston includes a base 28 and a circumferential wall 28*a* defining a coupling sleeve. The piston base 28 is further provided with drive formations comprising a circumferential array of driven teeth 37, which correspond to a similar circumferential array of driving teeth 36 around the input shaft 13. As illustrated in FIG. 3, the driving and driven teeth are engaged, but relative axial movement of the piston to the left causes the teeth to become disengaged. When engaged the driving and driven teeth 36, 37 provide a direct drive from the input shaft 13 to the piston 24 without circumferential play. A shoulder 38 of the input shaft limits relative rightward movement of the piston 24.

The driving and driven teeth 36, 37 comprise drive dogs of the disconnectable drive, but other kinds of axially movable positive drive are possible. A plurality of tine teeth may give easier engagement than a lesser number of coarse teeth. The skilled man will select the number and size of teeth according to the available materials and the torque to be transmitted. Furthermore, the precise shape of the teeth is also selectable according to design considerations, having regard to the functional requirements of smooth engagement and disengagement, and effective transmission of torque without substantial thrust forces in the axial direction.

Oil pressure, for example from an engine driven oil pump, is admitted by suitable connection to a radial inlet 41 through the wall of the pump housing 21, and via a groove 42 along the external surface of the pump shaft 22. Pressurized oil then passes radially inwardly between a clearance at the open end of the piston, and exhausts axially via a drain passage 43. A shuttle valve 44 is slidable in a bore 45 intersecting the drain passage and can move radially inwardly to close the drain passage on demand. As illustrated, the shuttle valve protrudes radially from the pump housing 21 in the open condition.

An axial groove 46 on the inside of the pump housing allows oil to pass to the left (as viewed) into an undercut 50 of the pump rotor where it can pass into the pump for lubrication purposes. It is intended that oil passes from groove 42 to groove 46 by virtue of the lubrication film about the pump shaft 22, though a circumferential groove linking the axial grooves 42, 46 may be provided if necessary, to the extent that the leakage of oil to the pump rotor is adequate for lubrication, but not excessive. Running clearance will be selected to give an appropriate volume flow of oil to the pump chamber sufficient to give adequate lubrication, and the flow rate can be determined empirically.

Oil under pressure may also leak to the left side of the piston (as viewed). Such oil is allowed to drain via radial and axial passages 47 at the base of the bore 23, and thence via a central drain bore 48 of input shaft 13. In passing to the bore 48, oil may also lubricate a thrust washer 49. Draining oil may also lubricate the coupling 14 before re-entering the engine in any convenient manner.

In the passive state, as illustrated in FIG. 3, the piston 24 is urged to the right by the disc springs 26, and the driving and driven teeth 36, 37 are engaged to give direct drive from the input shaft to the piston 24, and, by virtue of the splines 25, to the shaft 22 and the pump rotor. Accordingly, the vacuum pump is driven at the speed of the input shaft, e.g., at the speed of an engine camshaft. In this condition, oil under pressure, e.g., at 3-4 bar, is supplied to the inlet 41, and lubricates the drive arrangement of FIG. 3 and the pump rotor. The drain passage 43 is sufficiently large to ensure that oil pressure acting on the piston 24 is insufficient to overcome the resilient force of the disc springs 26.

If however, the shuttle valve 44 is moved radially inwardly to close the drain passage 43, oil pressure will increase on the right side of the piston 24 until the resilient force exerted by the disc springs is overcome. The piston 24 will, consequently, move to the left disengaging the driving and driven teeth 36, 37 and the clutch face 31 from the ring 32. In this condition, the piston is no longer driven by the input shaft, and, accordingly, rotation of the pump rotor ceases.

A full sequence of operations is illustrated with reference to FIGS. 4 to 9.

Figure 4:
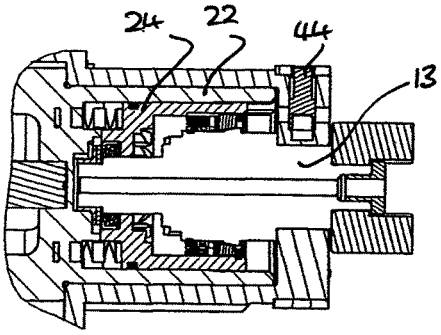
FIGS. 4 to 9 illustrate stages of operation of the pump of FIG. 3.

FIG. 4 illustrates the vacuum pump in an undriven condition; the shuttle valve 44 is closed, and, accordingly, oil pressure urges the piston 24 to the left to disengage the driving and driven teeth 36, 37 and the clutch ring 32 by virtue of the circlip 30 of piston 24. The piston 24, shaft 22 and pump rotor are stationary whereas the input shaft 13 is driven by the engine, and is rotating.

Figure 5:
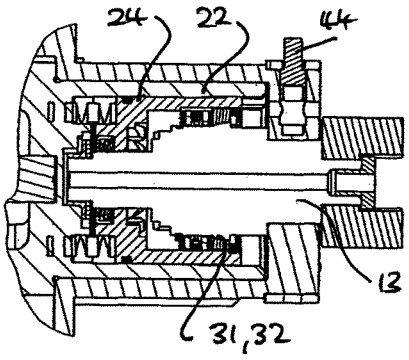

In FIG. 5, the shuttle valve 44 is opened to allow pressure on the right side of the piston 24 to fall. In consequence, the piston begins to move rightward under the resilient force of the disc springs 26. The driving and driven teeth 36, 37 are not engaged, but the circlip 30 releases the clutch ring 32, causing it to contact the clutch face 31, which, consequently, begins to turn by virtue of frictional forces at the contact face. The piston 24 also begins to rotate by virtue of the splines 33, which engage the clutch ring 32.

Figure 6:
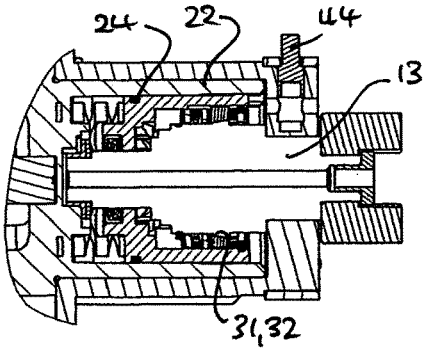

In FIG. 6 the piston has moved further to the right, and, after a short period, the rotational speed of the piston 24 approaches the speed of the input shaft 13.

Figure 7:
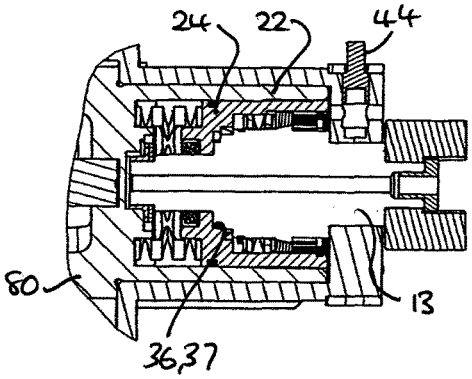

In FIG. 7 the rotational speed of the piston 24 and that of the input shaft 13 are synchronized, and rightward movement of the piston 24 is complete; the driving and driven teeth 36, 37 are engaged, and the clutch interface comprising the speed synchronizing mechanism no longer transmits torque from the input shaft 13 to the piston 24. The pump rotor 80 is directly driven by the input shaft.

Figure 8:
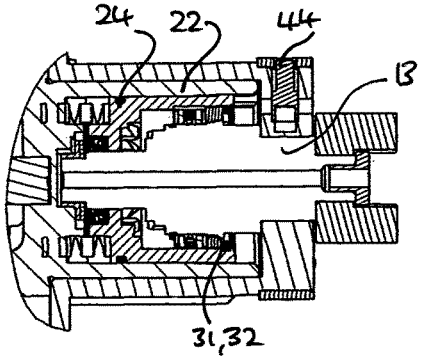
Figure 9:
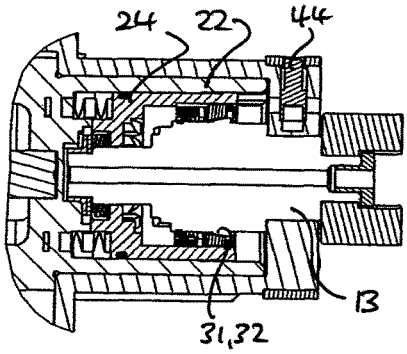

FIG. 8 illustrates the commencement of disengagement, whereby the shuttle valve 44 is closed (moved radially inwardly) so that pressure on the right side of the piston increases. As a result, the piston moves to the left, first disengages the driving and driven teeth 36, 37 and then, via circlip 30, the clutch, so that the components resume the undriven state of FIG. 9.

The shuttle valve 44 may be actuated in any suitable manner to engage drive to the vacuum pump when required. An electrical actuator may be used, but, preferably, a vacuum actuator directly responsive to the vacuum consumer, for example, a brake boost chamber, is provided. Thus, falling vacuum causes outward movement of the shuttle valve to engage drive to the vacuum pump. The shuttle valve may be resiliently biased, for example, by a coil compression spring, to the radially outward condition to ensure failsafe operation whereby, in the absence of a vacuum signal, drive is engaged (FIG. 7).

Any suitable material may be employed for the vacuum pump, and can correspond to those used for conventional vacuum pumps.

Mounting of the pump to a vehicle engine can be in any appropriate manner, and may comprise threaded fasteners through the holes 18 illustrated in FIG. 1.

Although described in relation to vacuum brake boosters, the pump may be used to provide vacuum for any other vacuum consumer of a vehicle. The protruding shuttle valve 44 provides for straightforward external actuation, either axially of the valve or transversely via a sleeve or the like, and furthermore provides a visual indication of engagement or disengagement.

The input shaft 13 and clutch ring 32. can be metal and have substantially non-wearing faces at the clutch interface, lubricated by oil from the input gallery 41.

Operation of the disconnectable drive coupling 20 is failsafe, the resilient rightward force on the piston ensuring drive engagement in the absence of sufficient oil pressure acting on the piston. Furthermore, the dog drive provides that a high starting torque of the pump rotor can be overcome without shock loading, owing to progressive speed matching of the input and output shafts.

Figure 10:
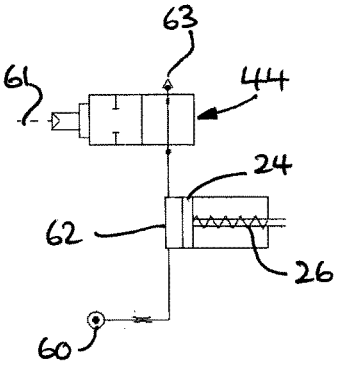
FIGS. 10 to 12 show hydraulic element functional circuits according to embodiments of the present invention.

FIG. 10 illustrates a CETOP functional hydraulic diagram in which the shuttle valve 44 controls a source 60 of oil under pressure to fill or exhaust a chamber 62 of the piston 24, which is urged leftward (as viewed) by spring 26. The shuttle valve is acted upon by vacuum in a control signal line 61 indicative of vacuum demand. The shuttle valve has two positions, as indicated; when no vacuum signal is applied, the chamber 62 is connected to a drain 63 and the clutch of the disconnectable drive coupling 20, comprising the friction and dog clutch previously described, connects the vehicle engine to the vacuum pump. As illustrated in FIG. 10, the coupling is engaged.

Should the level of vacuum in the control signal 61 increase, the shuttle valve moves to the alternative condition in which the outlet from the piston chamber 62 is blocked; pressure rises in the piston chamber and the piston moves rightward (as viewed) to disengage the coupling. In this condition, the vacuum pump is driven.

Figure 11:
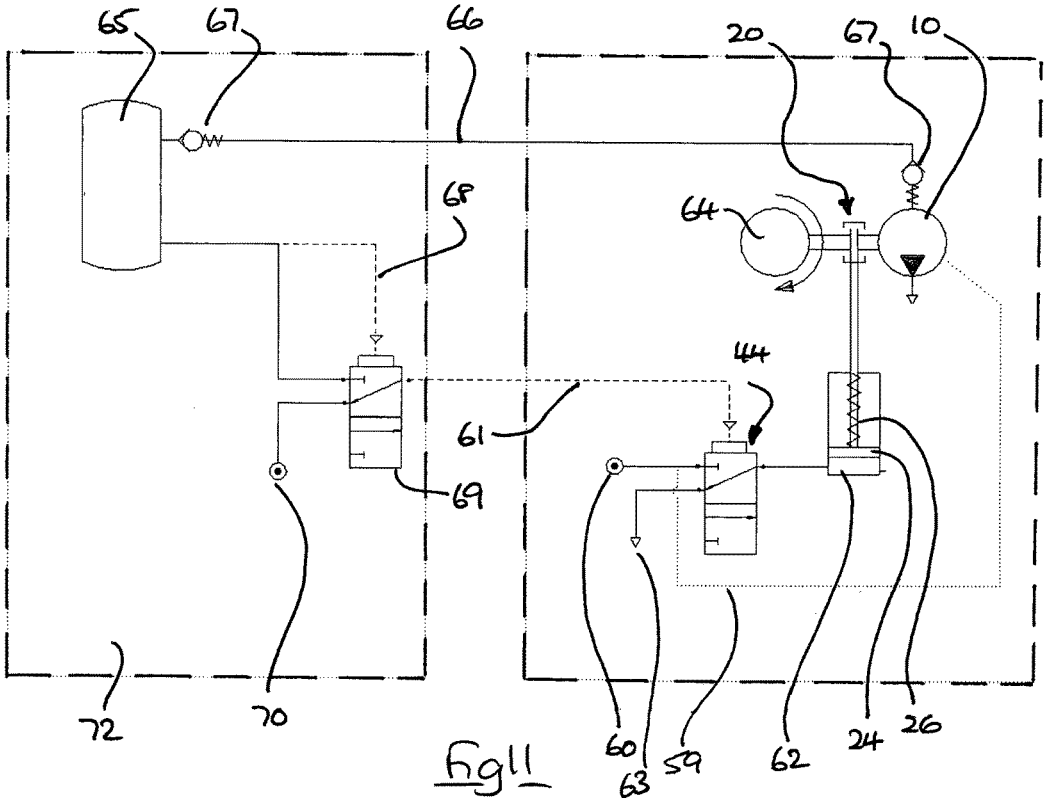

An alternative arrangement is illustrated in FIG. 11, in which common features carry the same reference numerals. In this case, a vacuum consumer comprises a vacuum brake booster 72, and an engine 64 drives a vacuum pump 10 via the disconnectable drive coupling 20.

A vacuum reservoir 65 of the brake booster is connected to the vacuum pump 10 via a vacuum duct 66, which may include non-return valves 67.

The level of vacuum in the reservoir 65 is indicated by a reference signal line 68 applied to a two-position vacuum valve 69. Should the level of vacuum be sufficient, the vacuum valve 69 will adopt the illustrated condition in which the control signal line 61 is connected to atmosphere 70, and, in consequence, the shuttle valve 44 also adopts the illustrated condition in which the chamber 62 is connected to drain 63—in this condition, the disconnectable drive coupling 20 is engaged by the internal spring 26, and is thus failsafe in the event that the control signal line 61 is breached, or the vacuum valve 69 malfunctions.

When the level of vacuum in the reservoir 65 is sufficient, the vacuum valve 69 moves upwardly (as viewed) from the illustrated position to connect the reservoir 65 to the control signal line 61. In consequence, vacuum is applied to the shuttle valve 44, which snaps to the alternative (upward) condition in which oil pressure from the engine acts on the piston 24 to disengage the drive coupling 20.

Also illustrated in FIG. 11 is a lubrication pathway 59 for the vacuum pump 10.

Figure 12:
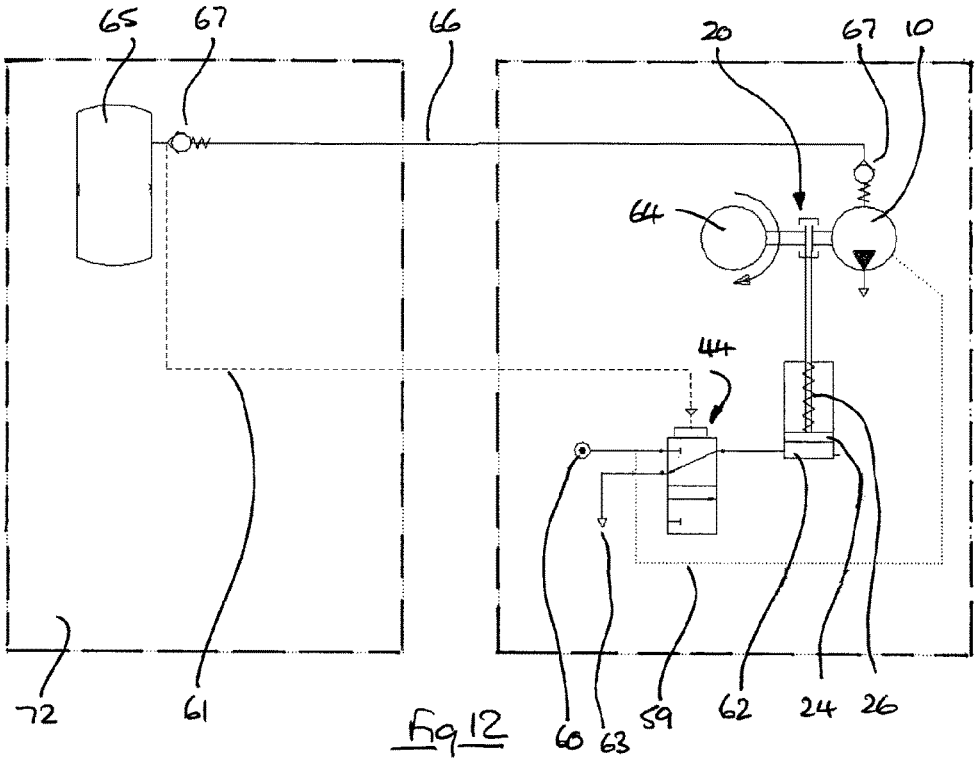

Yet another alternative is illustrated in FIG. 12. The arrangement of FIG. 12 is a simplified version of FIG. 11, in which common parts carry the same reference numerals. The vacuum valve 69 of FIG. 11 is omitted, and the vacuum signal line 61 is connected directly to the reservoir 65. Operation of the embodiment of FIG. 12 is the same as that for FIG. 11 whereby sufficient vacuum moves the shuttle valve to the upward condition to disengage the drive coupling 20 between the engine 64 and the vacuum pump 10.

Figure 13:
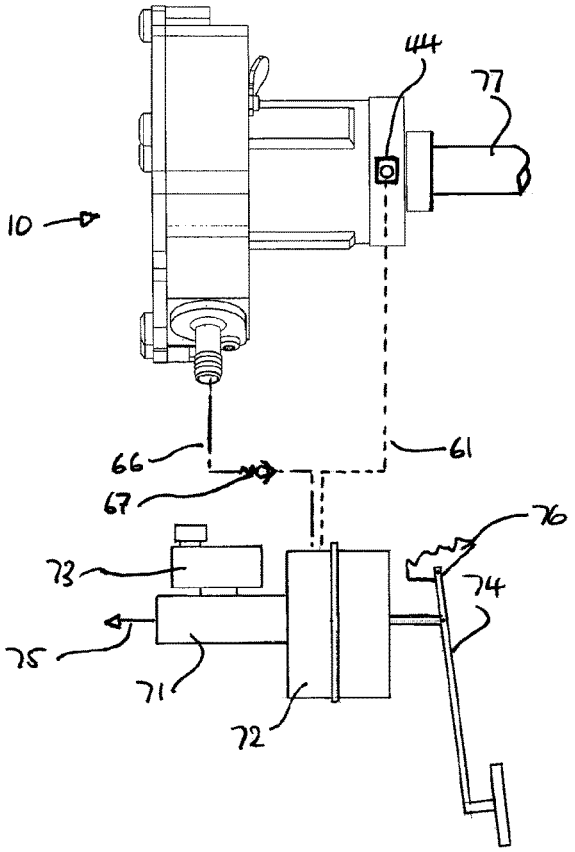
FIG. 13 illustrates a vacuum brake booster connected to a vacuum pump according to an embodiment of the present invention.

FIG. 13 illustrates schematically an exemplary installation of the vacuum pump with disconnectable drive coupling according to an embodiment of the present invention with respect to a vehicle hydraulic brake circuit, including the brake master cylinder 71, vacuum booster 72, fluid reservoir 73 and brake pedal 74; the hydraulic output of the master cylinder is represented by arrow 75, and the vehicle structure at 76.

Two vacuum connections are provided from the vacuum chamber of the booster 72 to the vacuum pump 10, namely, the vacuum duct 66 whereby the vacuum pump exhausts the brake booster when required and a signal duct 61, which provides a control signal indicative of the level of vacuum to the shuttle valve 44. The non-return valve 67 may be provided in the vacuum duct 66, or at the brake booster vacuum connection. The driving shaft for the vacuum pump is represented at 77.

It will thus be seen that the objects set forth above, among those made apparent from the preceding description, are efficiently attained, and since certain changes may be made without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention that, as a matter of language, might be said to fall therebetween.

What is claimed is:

1. A vacuum pump, comprising:

a disconnectable drive coupling, the disconnectable drive coupling including:

an input shaft;

a co-axial output shaft;

an annular piston;

a first set of engageable teeth provided on the annular piston and the co-axial output shaft, the first set of engageable teeth rotationally connecting the annular piston to the co-axial output shaft;

a second set of engageable teeth provided on the input shaft and the annular piston; and a speed synchronizing clutch;

wherein the annular piston is resiliently movable to an engaged state in which the input shaft is directly coupled for rotation with the annular piston via the second set of engageable teeth, and wherein the annular piston is movable in response to an increase in fluid pressure to a disengaged state in which the input shaft is decoupled from rotation with the annular piston.

2. The vacuum pump according to claim 1, wherein the input shaft is journalled in the output shaft, wherein the output shaft defines a cylinder bore for the annular piston, and wherein the annular piston is fixed against rotation relative to the cylinder bore via the first set of engageable teeth.

3. The vacuum pump according to claim 1, wherein the annular piston comprises a base and a wall defining a coupling sleeve, and wherein the second set of engageable teeth comprises driven teeth on the base engageable with driving teeth on the input shaft.

4. The vacuum pump according to claim 3, wherein the annular piston includes an internal clutch ring fixed in rotation with respect to the annular piston and movable axially with respect to the annular piston, the clutch ring defining an oblique circular clutch face engageable with a corresponding circular clutch face of the input shaft.

5. The vacuum pump according to claim 4, wherein the oblique circular clutch face and the corresponding circular clutch face of the input shaft are biased into engagement by at least one spring acting between the input shaft and the clutch ring.

6. The vacuum pump according to claim 1, wherein the annular piston engages a shoulder of the input shaft in the engaged state.

7. The vacuum pump according to claim 1, wherein the output shaft has an axially extending, radially external circular bearing surface, and the drive coupling further includes a housing defining a bore configured to receive the bearing surface for rotation in the bore.

8. The vacuum pump according to claim 7, wherein the output shaft comprises a pump rotor, and the housing comprises a pump rotor chamber.

9. The vacuum pump according to claim 8, wherein the housing includes an inlet for fluid under pressure, the inlet opening to the bearing surface and being connected via the bearing surface to the annular piston to facilitate movement to the disengaged state.

10. The vacuum pump according to claim 9, wherein the inlet is connected via the bearing surface to the pump rotor to facilitate lubrication.

11. The vacuum pump according to claim 9, wherein the housing includes an exhaust valve whereby fluid pressure acting on the annular piston is relieved on demand.

12. The vacuum pump according to claim 11, wherein the exhaust valve comprises a spool valve slidable in a bore from an open to a closed state to block a fluid drain passage on demand.

13. The vacuum pump according to claim 12, wherein the spool valve protrudes from the housing in the open state.

14. A vehicle engine, comprising the vacuum pump as claimed in claim 1.

15. The vacuum pump according to claim 1, wherein the speed synchronizing clutch comprises mutually engageable clutch faces independent from the second set of engageable teeth.

* * * * *